US007625474B1

(12) United States Patent
Shepodd et al.

(10) Patent No.: US 7,625,474 B1
(45) Date of Patent: Dec. 1, 2009

(54) METHOD FOR A MICROFLUIDIC WEAKLINK DEVICE

(75) Inventors: Timothy J. Shepodd, Livermore, CA (US); Matthew P. Duncan, Augusta, GA (US)

(73) Assignee: Sandia Corporation, Livermore, CA (US)

( * ) Notice: Subject to any disclaimer, the term of this patent is extended or adjusted under 35 U.S.C. 154(b) by 0 days.

(21) Appl. No.: 12/263,905

(22) Filed: Nov. 3, 2008

Related U.S. Application Data

(63) Continuation of application No. 11/021,281, filed on Dec. 23, 2004, now abandoned.

(51) Int. Cl.
*G01N 27/447* (2006.01)

(52) U.S. Cl. ..... 204/450; 204/451; 422/103

(58) Field of Classification Search ..... 204/450–455, 204/600–605; 422/103
See application file for complete search history.

(56) References Cited

U.S. PATENT DOCUMENTS

| | | | | |
|---|---|---|---|---|
| 5,924,741 | A | 7/1999 | Karlsen | |
| 6,013,164 | A | 1/2000 | Paul | |
| 6,019,882 | A | 2/2000 | Paul | |
| 6,033,544 | A | 3/2000 | Demers | |
| 6,224,728 | B1 | 5/2001 | Oborny | |
| 6,277,257 | B1 | 8/2001 | Paul | |
| 6,375,901 | B1 * | 4/2002 | Robotti et al. | 422/103 |
| 6,488,872 | B1 * | 12/2002 | Beebe et al. | 264/31 |
| 6,770,183 | B1 | 8/2004 | Hencken | |
| 6,770,201 | B2 | 8/2004 | Shepodd | |
| 6,782,746 | B1 | 8/2004 | Hasselbrink | |
| 6,988,402 | B2 * | 1/2006 | Hasselbrink et al. | 73/253 |
| 2004/0060864 | A1 | 4/2004 | Shepodd | |
| 2004/0123658 | A1 | 7/2004 | Kirby | |
| 2004/0173459 | A1 | 9/2004 | Kirby | |

OTHER PUBLICATIONS

J. M. Covan; J. A. Cooper; "Predictable Safety in Control of High Consequence Systems", Third IEEE International High-Assurance Systems Engineering Symposium, Nov. 13-14, 1998, Washington, DC.

I. Gitlin; A. D. Stroock; G. M. Whitesides; A. Adjari; "Pumping Based on Transverse Electrokinetic Effects", Applied Physics Letters, 2003, vol. 83, No. 7, pp. 1486-1488.

Studer, et al; "An Integrated AC Electrokinetic Pump in a Microfluidic Loop for Fast and Tunable Flow Control", The Analyst, 2004, vol. 129, No. 10, pp, 944-949.

Nam-Trung Nguyen; Steven T. Wereley; Fundamentals and Applications of Microfluidics, 2002, Artech House, Boston, MA.

* cited by examiner

*Primary Examiner*—Alex Noguerola
(74) *Attorney, Agent, or Firm*—Michaelson & Wallace; Timothy P. Evans

(57) ABSTRACT

The present invention relates to an electrokinetic (EK) pump capable of creating high pressures electroosmotically, and capable of retaining high pressures. Both pressure creation and retention are accomplished without the need for moving parts. The EK pump uses a polymerizable fluid that creates the pressure-retaining seal within the EK pump when polymerization is initiated, typically by exposure to UV radiation. Weaklink devices are advantageously constructed including such a pressure-retaining EK pump since, among other advantages, the response of the weaklink device relies on predictable and reliable chemical polymerization reactions.

8 Claims, 4 Drawing Sheets

METHOD FOR A MICROFLUIDIC WEAKLINK DEVICE

CROSS-REFERENCE TO RELATED APPLICATIONS

This application is a Continuation application of prior U.S. patent application Ser. No. 11/021,281, now abandoned, originally filed Dec. 23, 2004 and entitled "Microfluidic Weaklink Device," from which priority is claimed and which is herein incorporated by reference in its entirety.

STATEMENT OF GOVERNMENT INTEREST

This invention was made with Government support under government contract no. DE-AC04-94AL85000 awarded by the U.S. Department of Energy to Sandia Corporation. The Government has certain rights in the invention, including a paid-up license and the right, in limited circumstances, to require the owner of any patent issuing on this invention to license others on reasonable terms.

BACKGROUND OF THE INVENTION

1. Field of Invention

This invention relates generally to the field of weaklink devices and, more particularly, to weaklink devices including electrokinetic pumps, and to electrokinetic pumps suitable modified for use as weaklinks as well as for other purposes.

2. Description of the Prior Art

There are many examples in commercial and military applications of the transmission or management of large amounts of energy under the control of safety-critical systems. These control systems must maintain the energy release within the safe bounds established for the process, as well as insure against abnormal (and possibly catastrophic) release of large amounts of energy due to system malfunction, whether accidental, malevolent or due to normal but uncorrected wear and tear.

Properly designed control systems typically include one or more "weaklinks." A "weaklink" element in a control system is taken herein to mean an element, critical to control system function, whose activation or failure will cause the system to become safe before serious negative consequences result. As noted by Covan and Cooper, weaklinks are advantageously designed to respond passively, relying on predictable physical or chemical properties to insure system safety (Covan, J. M., and Cooper, J. A., "Predictable Safety in the Control of High Consequence Systems," *Third IEEE International High-Assurance Systems Engineering Symposium*, Nov. 13-14, 1998, Washington, D.C.). Weaklinks have also found application in off-shore equipment and components, such as undersea tubes or pipes, at risk for unforeseen pulling forces due to ships' anchors or fishing gear (U.S. Pat. No. 5,924,741).

Microfluidics is a research and engineering discipline dealing with transport phenomena and fluid-based devices at microscopic length scales. Some authors state that microfluidic devices have the potential to effect a major change in instrumentation by producing cheap, disposable systems for the mass market. See, for example "*Fundamentals and Applications of Microfluidics*," by N.-T Nguyen and S. T. Wereley, Artech House, 2002. Therefore, a need exists in the art for weaklink devices based upon microfluidics, offering the possibility of employing multiple microfluidic weaklink devices in safety systems with multiple levels of redundancy, thereby increasing the overall reliability of the safety systems.

SUMMARY OF THE INVENTION

Accordingly and advantageously the present invention relates to a microfluidic weaklink device including an electrokinetic (EK) pump with a polymerizable fluid therein. Upon polymerization of the polymerizable fluid, a pressure-retaining seal is created in the EK pump. Thus, the advantages of microfluidic technology are conveniently brought to the field of weaklinks, including but not limited to the relatively low cost of typical microfluidic devices.

Unlike other typical microfluidic devices and pumps, the present EK pump with polymerizable fluid requires no moving parts to create or to hold high pressures. Photopolymerizable fluids are conveniently employed: advantageously, fluids polymerizable by exposure to ultraviolet (UV) radiation.

These and other advantages are achieved in accordance with the present invention as described in detail below.

BRIEF DESCRIPTION OF THE DRAWINGS

To facilitate understanding, identical reference numerals have been used, where possible, to designate identical elements that are common to the figures. The drawings are not to scale and the relative dimensions of various elements in the drawings are depicted schematically and not to scale.

The techniques of the present invention can readily be understood by considering the following detailed description in conjunction with the accompanying drawings, in which.

DETAILED DESCRIPTION OF EMBODIMENTS OF THE INVENTION

After considering the following description, those skilled in the art will clearly realize that the teachings of the invention can be readily utilized in the fabrication of weaklink devices employing electrokinetic (EK) pumps, in the fabrication of electrokinetic pumps and in the design of safety systems employing such devices.

EK pumping moves fluids making use of surface forces. Some embodiments of EK pumps move fluids having small particles entrained therein. For economy of language, we use "fluid" herein to denote a liquid as well as a liquid including particles entrained with, and moving along with, the liquid.

The surface forces used to move fluids in an EK pump generally scale well when length-scales are reduced. Thus, EK pumps are widely used for moving fluids at small length scales, and are easily integrated into microfluidic systems. Typically, EK pumps are advantageously employed for pumping micro- and nano-liter (i.e., μL, nL respectively) quantities of fluid through channels having typical lateral dimensions less than, or of the order of, approximately 500 μm in diameter (μm=micron=micrometer=$10^{-6}$ meter). Ordinarily, EK pumps can be constructed to have the capability of generating maximum pressures practically limited by the pore size distribution and theoretically limited by the crush strength (or failure modulus) of the supporting medium, that is, until the pump physically crushes. Maximum pump pressures in excess of tens-of-thousands psi (pounds-per-square-inch) are feasible when ceramic media are used.

Figure 1:
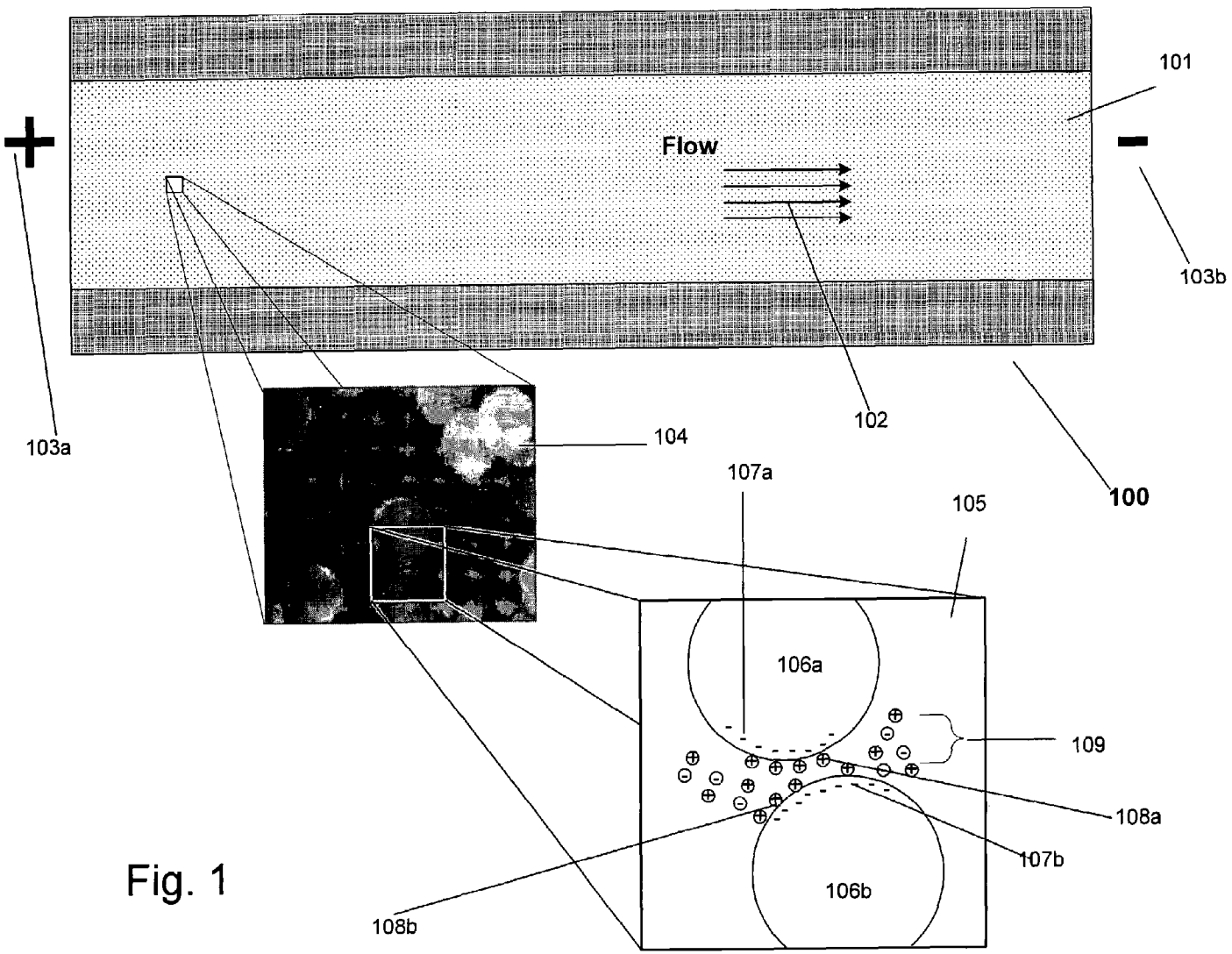
FIG. 1 depicts in schematic cross-section and enlarged views, a typical electrokinetic pump.

FIG. 1 depicts in schematic form, including enlarged segments, a typical electrokinetic pump 100, including a porous medium 101 through which fluid 102 flows when subject to an electric field as typically created by voltages applied to electrodes, 103*a* and 103*b*. The porous medium is depicted in enlarged view as 104. For economy of language, we refer to the three-dimensional network of passages through the porous medium 104 as "pores" and a typical size of the openings that are encountered as fluid passes through this network as "pore size," understanding thereby that a distribution of opening sizes is actually present.

105 in FIG. 1 is an enlarged and schematic view of typical components of the porous medium 101. When a polar fluid 109 and the solid comprising the porous medium, 106*a* and 106*b*, are brought into contact, the surface of the solid generally acquires an electric charge, 107*a*, 107*b*. Ions in the fluid migrate towards the surface of the solid and form a reasonably tightly bound, thin layer, 108*a*, 108*b*. The charge layers on the surfaces, 107*a*, 108*a*, 107*b*, 108*b* influence the charge distribution elsewhere in the fluid creating an electric double layer that includes a "shear surface" or "shear plane" as a dividing surface between the tightly bound charges and charges mobile under the influence of an applied electric field. The difference in electrical potential between the solid surface and the shear plane, or zeta potential, is an important parameter characterizing electrokinetic phenomena. The properties of the surface and the fluid determine the zeta potential which can be either positive or negative. Thus, when an applied electric field is applied, fluid can be driven in a direction along the applied electric field (for example) or, in the case of a zeta potential having opposite sign, opposite to the applied electric field. For discussion herein we make no distinction as to the direction of fluid flow with respect to the applied electric field since, under proper surface and fluid conditions, either is possible. For further details, see Nguyen and Werely supra, p. 53 ff, incorporated herein by reference.

When ions are driven through an EK pump under the influence of an applied electric field, the viscous forces of the liquid are typically sufficient to drag along the other fluid components, including small Particles that may be entrained in the fluid. These effects are most pronounced under conditions of small pore sizes as typically occur in EK pumps, typically less than about 50 μm in many cases.

On a microscopic level, the mode of operation of an EK pump derives from the application of electrical forces to ionic components of the working fluid. These forces result in motion of the fluid when volume is available into which flow can occur, or to the development of high pressures when flow is hindered. Thus, an EK pump moves fluid, generates pressure, or both.

Performance as a weaklink calls for a substantial change in the operating characteristics of the electrokinetic pump when environmental conditions call for activation of the weaklink. For this purpose, it is found to be advantageous that the fluid 102 be such that it can be polymerized when desired. Polymerization of the working fluid leads to an increase in viscosity causing a reduction or elimination of effective porosity such that the device no longer functions as an EK pump, whether or not a voltage is applied. Extensive polymerization typically causes an increase in viscosity to such an extent as to create a pressure-retaining seal of the EK pump. That is, the working fluid becomes a solid or sufficiently close to the properties of a solid so as to effectively seal the EK pump. Thus, it is desired that a fluid be formulated that functions as a working fluid for an EK pump but can be polymerized when desired, increase its viscosity and form a pressure-retaining seal of the porous medium through which the fluid is pumped. The formulation and use of such a fluid in combination with an EK pump is an important objective of the present invention.

In connection with some embodiments of the present invention, we consider EK pumps and associated systems in which there is no (or small) net fluid flow, but rather development of pressure and its retention within the EK pump and the fluidic system. However, even in such cases, there is generally fluid flowthrough, within and around the openings in the porous medium of the EK pump. That is, substantial mass of fluid can be in motion within the EK but without significant net translation of mass. For economy of language we use "fluid flow" to indicate a net fluid flow or translation of mass, understanding thereby that an absence of "fluid flow" does not imply a fully stationary mass of fluid within the EK pump.

It is convenient in the practice of the present invention that the polymerizable fluid is photopolymerizable, typically by exposure to ultraviolet (UV) radiation. However, this is not an essential restriction. Fluids that are polymerizable under selective exposure to one or more catalysts, exposure to heat, electron or other particle beams, or electromagnetic radiation having wavelengths outside the UV portion of the spectrum (visible, x-ray, among others) are included within the scope of the present invention. For economy of language, we refer to all such substances as polymerizable or photopolymerizable, recognizing that thermal, particle beam or other polymerization mechanisms are not thereby excluded.

Operation of such an EK pump as a weaklink could entail, for example, activating a source of polymerizing radiation or the removal of a blocking shutter and exposing the EK fluid to a continuously-on source of polymerizing radiation, among others. In any case, polymerization is initiated, thereby ceasing fluid flow and retaining for substantial periods of time (or indefinitely) the pressure attained.

EXAMPLES

Figure 2:
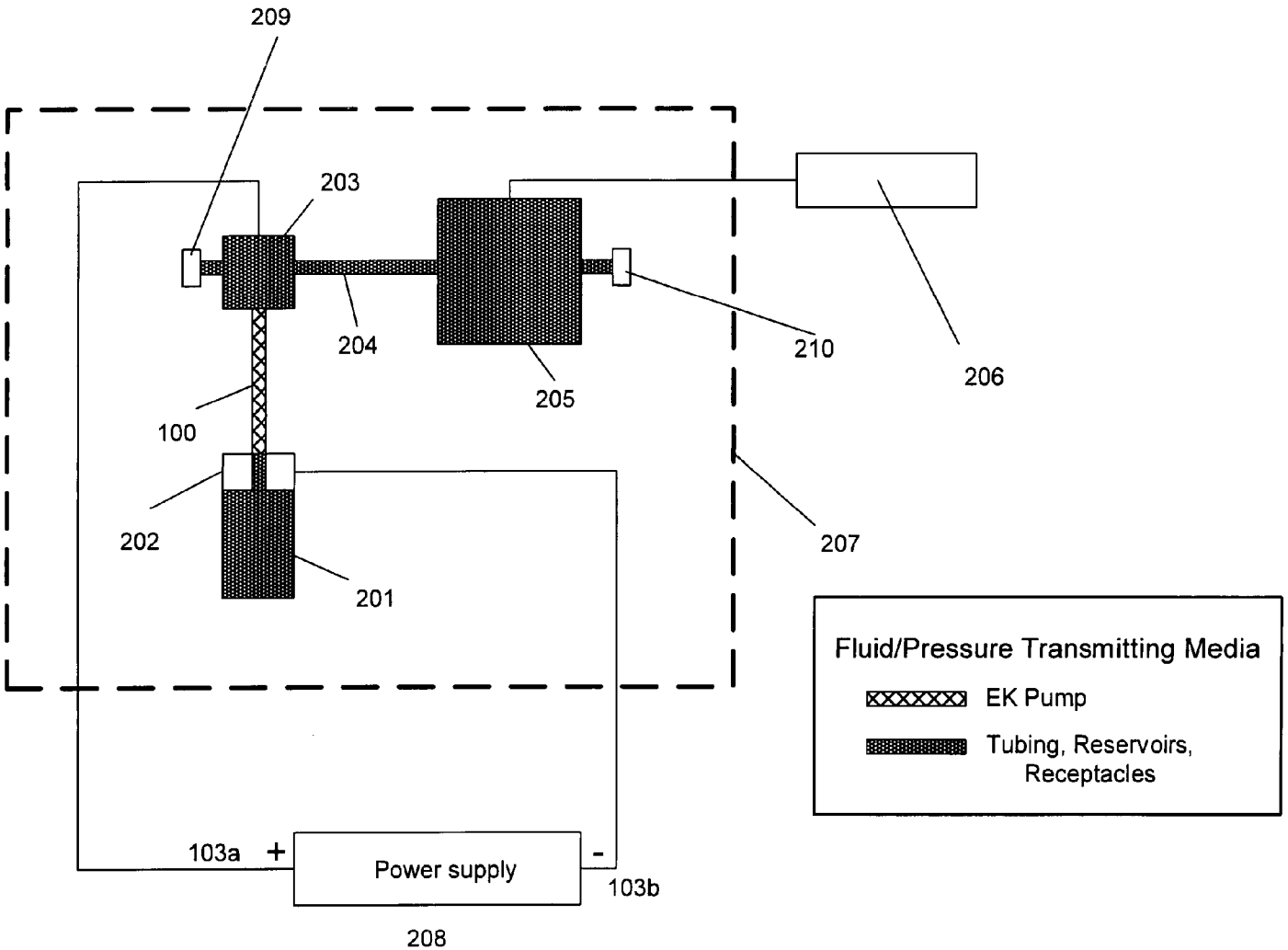
FIG. 2 depicts in schematic cross-section a typical experimental arrangement for evaluating sealing and pressure-retention characteristics of an electrokinetic pump.

FIG. 2 depicts in schematic form a device to test the pressure-retaining characteristics of EK pumps with specific polymerizable fluids. For these examples and for economy of language, we describe specific cases of UV polymerizable fluids, recognizing that this is illustrative only and not a limitation on the scope of the present invention.

The EK pump, 100, is attached to a fluid reservoir 201 and electrically connected to electrodes 202 and an electrode included in block 203 but not specifically depicted in FIG. 2. Power supply 208 supplies a voltage to either end of the EK pump, 103*a*, 103*b*, causing fluid to flow and/or pressure to build. Note that the fluid flow in FIG. 2 is depicted to be in the opposite sense (from − to +) from the direction of flow depicted in FIG. 1 (+ to −). However, as discussed elsewhere herein, the sense of flow with respect to the applied electric field is determined by the sign of the zeta potential. An EK pump can be constructed in which either a positive or a negative zeta potential is employed (but not both in the same pump).

The EK pump 100 exerts a force on the fluid within it, in a bottom-to-top direction for the example depicted in FIG. 2. This force causes fluid to move (perhaps transiently) and/or pressure to build. As depicted in FIG. 2, the force on the fluid developed by the EK pump is directed through tube 204 to pressure transducer 205 which is electrically connected to a suitable recording or read-out device. 206, 209 and 210 are caps or pressure release valves that, when closed, do not allow for continuous fluid flow, but cause pressure to increase and be recorded by 206.

Upon attaining the desired pressure, the working fluid in EK pump 100 is then polymerized causing the pressure developed in 205 (that is, downstream from the polymerized fluid) to become blocked. Retention of the pressure in 205 is one objective of the present invention.

It is convenient in some embodiments of the present invention to cause polymerization by bathing in UV radiation the working fluid passing through EK pump 100. 207 denotes a chamber containing sources of UV radiation that, when activated, expose the working fluid to its polymerizing effects. EK walls transparent to the polymerizing radiation facilitate exposure and are advantageously employed in some embodiments of the present invention. For example, the DUPONT® (E. I. du Pont de Nemours and Company, Wilmington, Del.) commercial product TEFLON® AF, coated on the silica capillary containing the EK pump, is conveniently employed, although other transparent fluoropolymers could be used as well.

Polymerization can be controlled by controlling the exposure to UV radiation by any, or any combination of several means. For example, the transparent regions of the EK pump walls can be limited in geometric extent. A source of UV radiation can be employed having a limited beam width, or by limiting the exposure time, or by other means. In all such cases, the goal is to cause polymerization of the working fluid in or around EK pump 100, causing the pressure developed in transducer 205 to be retained even though the driving voltage from power supply 208 is turned off.

Example 1

Electrokinetic Pump

Illustrative examples of typical EK pumps can be fabricated in fused silica columns having an inner diameter of approximately 100 μm and lengths ranging from approximately 1 cm to 30 cm. For example, a new fused silica column is typically flushed with a pretreating solution containing a binding agent. This pretreatment facilitates the covalent bonding of the porous polymer monolith to the walls of the silica column. Following pretreatment (by a time period typically greater than about 1 hour), the column is flushed with a buffer (for example, 5 milliMolar (mM) phosphate buffer at pH about 7.5) and the buffer is blown out, typically by means of an air syringe. A single phase monomer solution is prepared. In this example the monomer includes ethylene glycol, dimethacrylate, butyl methacrylate, tetrahydrofurfuryl methacrylate, [2-(Methacryloyloxy)ethyl]trimethylammonium methyl sulfonate (MOE), or MOE with a chloride counter ion replacing methyl sulfonate, IRGACURE® 1800 (Ciba Specialty Chemicals, Inc., Basel, Switzerland), acetonitrile, approximately 5 mM phosphate buffer (pH 7.5) and ethanol. This solution is thoroughly mixed and filtered (0.25 micron PTFE membrane) into two 2-milliLiter (mL) vials. Oxygen is removed from the air above the solution by purging with three successive vacuum/nitrogen cycles, including sonication while under vacuum. The pretreated columns are filled with the degassed monomer solution and connected with the two vials (each sealed with a septum). The two vials with columns are placed into a SPECTROLINKER® XL-1500 ultraviolet crosslinker (Spectronics Corporation, Westbury, N.Y.) for about 30 minutes. Ultraviolet light initiates the polymerization of the suspension. A porous polymer monolith is thus formed in the vials and columns with a nominal cell size of about 0.1 micron. After removal from the ultraviolet crosslinker, the vials and columns are allowed to sit at room temperature for about 24 hours to complete polymerization. The column is then removed from its attachment to the vials and purged under pressure with the buffer that will be used in the running EK pump, in this case 30 mM acetate buffer with pH about 5.0. This purging process removes unreacted reagents from the system, resulting in an EK column.

Example 2

Pressure Retention

The EK pump as prepared in Example 1 is tested in an experimental apparatus substantially as depicted schematically in FIG. 2. In this example, the apparatus includes a BERTAN® Model ARB 30 power supply (Spellmen High Voltage Electronic Corporation, Hauppauge, N.Y.) 208, with one terminal thereof connected to a 4-way HPLC (high-performance-liquid-chromatography) fitting 203. EK pump 100 is connected to fitting 203 and to vial 201 containing the EK working fluid buffer (typically a 2 milliLiter (mL) vial) and to electrode 202, advantageously a platinum electrode. Of the remaining two openings in HPLC fitting 203, one is capped with pressure release valve 209 and the other is connected to pressure transducer 205 by means of tube or pipe 204. A SENSO-METRICS® pressure transducer (Senso-Metrics, Incorporated, Simi Valley, Calif.) is advantageously employed as 205. A suitable pressure read-out 206, is employed, typically a digital read-out. Remaining openings in the pressure transducer are capped, conveniently with one or more pressure release valves 210.

In running an experimental test, the absolute voltage delivered by power supply 208 is increased to its desired operating value and held. For typical test runs, the applied voltage is adjusted so as to yield electric fields within the EK pump in the range of approximately 100-300 V/cm (volts per centimeter). Typically, 1-2 hours are required for the pressure to equilibrate once the applied voltage has stabilized. In general, EK pumps with larger pores equilibrate faster, but at lower pressures, than those having smaller pores. Typical pressures in the range of approximately 0.1-0.5 V/psi are obtained with a 20 cm EK pump column.

When pressure has equilibrated, vial 201 is replaced with a vial containing a monomer solution, typically releasing a small amount of fluid through valve 209, 210 or similar to accomplish the replacement. Other embodiments include moving the monomer into EK pump 100 through an open system employing another pumping means, typically another EK pump (not depicted in FIG. 2). Once delivered to pump 100, the delivering pump can be sealed by polymerizing the monomer therein, for example, by selective exposure to polymerizing UV radiation.

The monomer solution is advantageously formulated so as to form a polymeric gel (salt bridge) upon photoinitiated polymerization. For example, a typical monomer solution is 1.85 mL of 50% N,N-dimethyl-N-methacryloxyethyl-N-(3-sulfopropyl)-ammonium betaine (SPE) solution in 35 mM acetate buffer (pH 5.0). A typical cross-linking agent in this example is 50 mg of N,N'-methylenebisacrylamide. In addition to the buffer and SPE solution noted above, the solution also contains approximately 40 μL of 2-methyoxyethanol and 40 μL of acetate buffer. A photoinitiator advantageously employed in this example is 10 mg of 2,2'-azobis(2-amidinopropane) dihydrochloride, as the commercial product V-50 (Wako Chemical Co.).

With the voltage off, any residual pressure in the system is released through a valve such as 209, 210 among others. The voltage is then re-applied and the pressure in the system rises again, delivering a portion of the SPE-containing monomer solution into the EK pump. Since the monomer solution is zwitterionic, the permittivity of the solution within the EK pump increases (and the conductivity decreases) in comparison with the values obtained by the buffer solution present prior to the introduction of the SPE-containing monomer. This change in permittivity and conductivity can lead to increased efficiency of the EK pump and may, in some cases, cause higher pressures to be obtained than those achieved with only buffer solution present.

Figure 3:
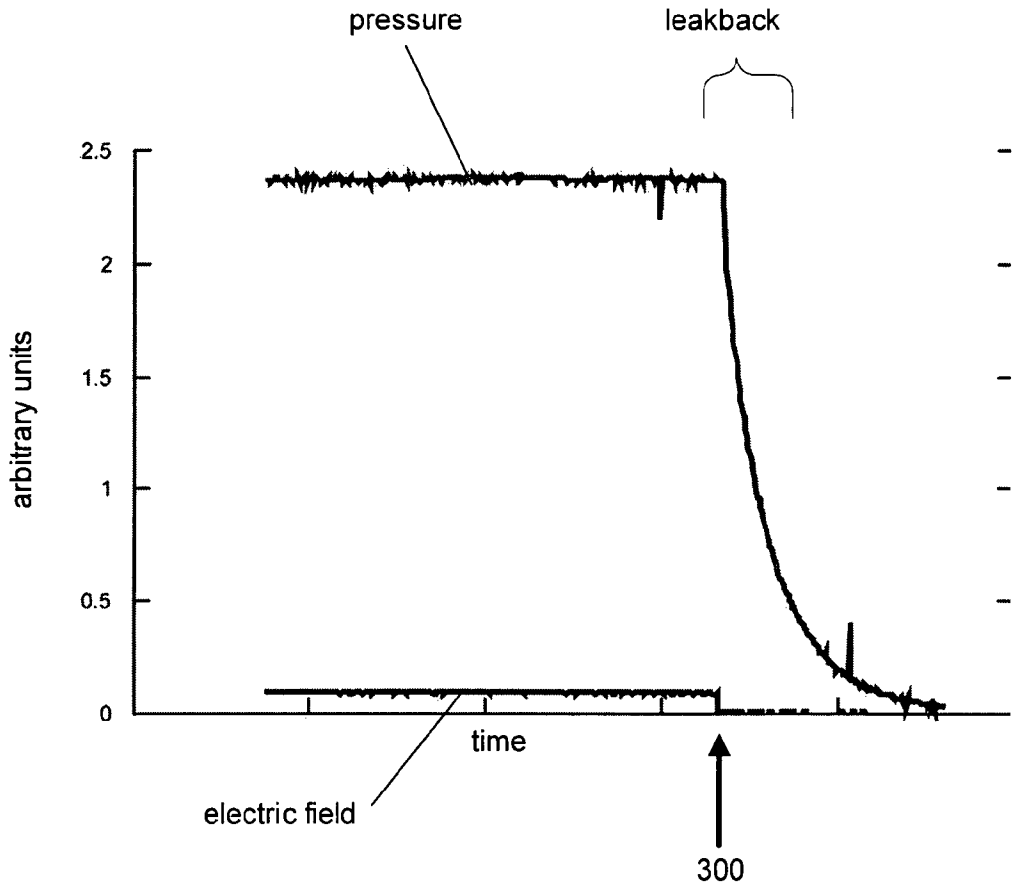
FIG. 3 is a graphical depiction of pressure loss (leak back) in a conventional electrokinetic pump when voltage (or, equivalently, electric field) is turned off.

The UV illumination is then applied, leading to polymerization of the SPE-containing monomer. When polymerization has been achieved, the voltage can be switched off without significant diminution of pressure being observed. In typical cases, pressure loss following polymerization was reduced by a factor of about 500 in comparison with pressure loss in the absence of polymerization. FIG. 3 depicts a typical pressure loss when polymerization is absent and the electric field is removed at time 300.

Figure 4:
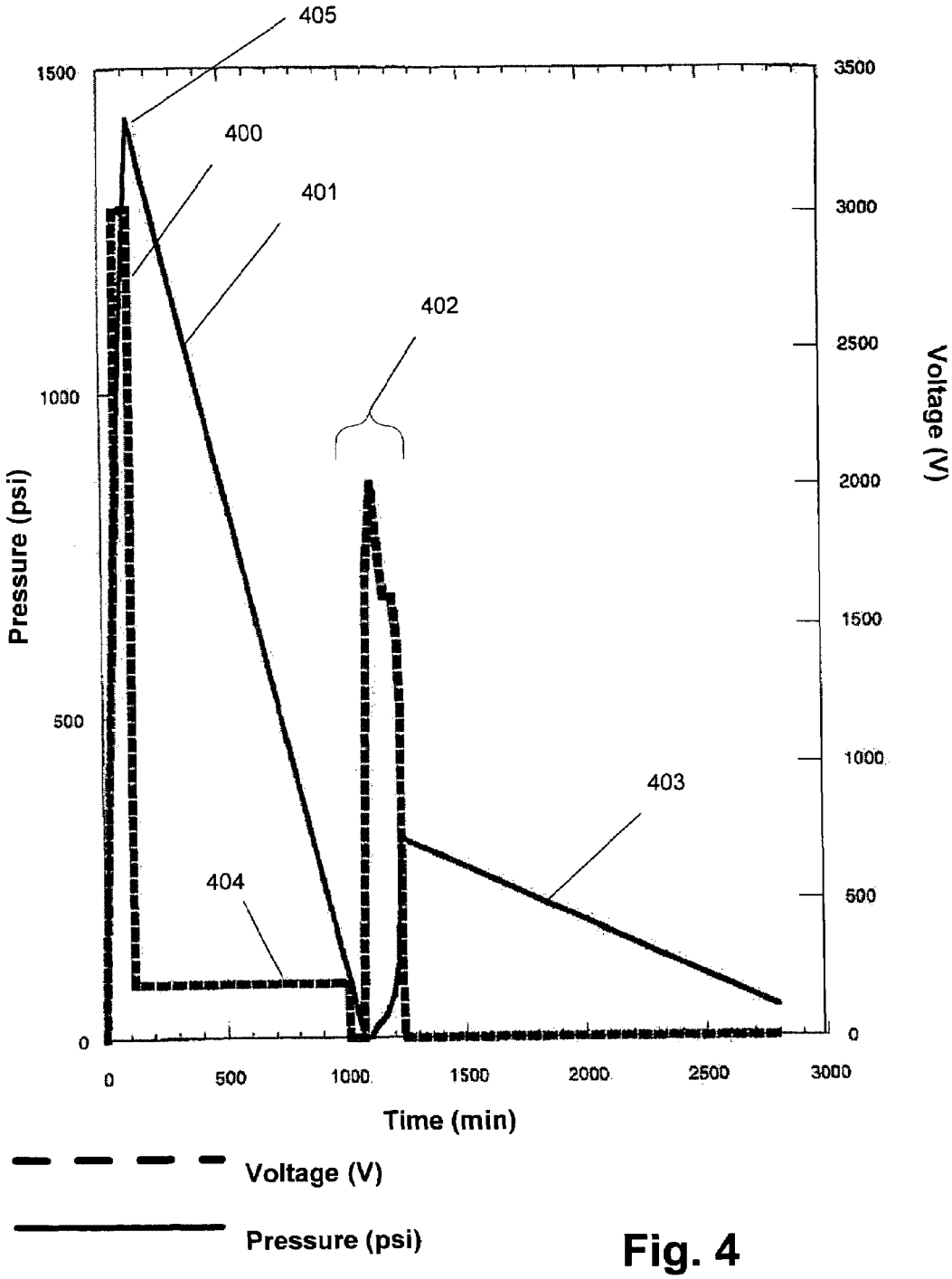
FIG. 4 is a graphical depiction of pressure retention following polymerization of the fluid in the electrokinetic pump in comparison with pressure drop in the absence of polymerization.

FIG. 4 depicts the effect of polymerization on pressure retention in the EK pump described above. This example provides specific numerical values for voltage, pressure and leak back times for the particular EK pump described above and is illustrative of some embodiments of the present invention.

A voltage of about 3,000 volts is applied for about 100 minutes, 400, followed by a constant voltage of about 97 V, maintained until about 1,000 minutes have elapsed, 404. The voltage spike 400 causes pressure to rise to about 1,425 psi, 405. Reduction of the voltage 404 allows the pressure to leak back to essentially a zero value, 401. Leak back 401 occurs in FIG. 4 at a rate of approximately 1.5 psi/minute.

Polymerizing UV radiation is applied to the EK pump 402 at the same time as a second (and smaller) voltage spike than 400. The wavelength and intensity of the applied UV radiation is chosen to be appropriate for the concentration and identity of the photoinitiator used. In this example, UV having 365 nanometer wavelength is applied for approximately 19 minutes (time 1220-1239 minutes). The peak voltage is about 2000 V. The pressure drop following polymerization 403 is seen to be markedly less than that occurring without polymerization. Although the polymerization performed here did not form a completely pressure-tight seal, the pressure leak back occurs at a rate approximately 25× slower than the leak back without polymerization (0.06 psi/min compared to 1.5 psi/min).

Although various embodiments which incorporate the teachings of the present invention have been shown and described in detail herein, those skilled in the art can readily devise many other varied embodiments that still incorporate these teachings.

We claim:

1. A method for providing a microfluidic system weaklink valve, comprising the steps of:

a.) providing an electrokinetic (EK) pump comprising a porous medium disposed within the EK pump and covalently bonded to an interior surface;

b.) filling the EK pump with a buffer fluid capable of electroosmotic flow;

c.) connecting a first end of the EK pump to a fluid reservoir containing a quantity of a polymerizable solution comprising monomers of N,N-dimethyl-N-methacryloxyethyl-N-(3-sulfopropyl)-ammonium betaine (SPE);

d.) connecting a second end of the EK pump to a closed fluidic system;

e.) displacing a portion of the buffer fluid within the porous medium with a portion of the solution of SPE monomers;

f.) applying an electrical potential between the first and second ends sufficient to provide an electroosmotic transport into the closed fluidic system thereby hydraulically pressurizing the EK pump and the closed fluidic system;

g.) polymerizing the portion of the solution of SPE monomers to form a pressure seal, wherein the hydraulic pressure within the closed fluidic system is maintained even if or when the electrical potential is subsequently compromised, removed or lost.

2. The method of claim 1, wherein the step of polymerizing comprises exposure to UV radiation.

3. The method of claim 2, wherein at least a portion of the EK pump is optically transparent to UV radiation.

4. The method of claim 1, wherein the working fluid is a 30 mM acetate buffer solution having a pH of about 5.0.

5. The method of claim 1, wherein the step of providing an EK pump, further comprises:

a) providing a tube comprising first and second open ends, and a bore, the bore having a surface;

b) treating the bore surface with a solution containing a binding agent, wherein the binding agent is selected to facilitate covalent bonding to the bore surface;

c) purging the solution containing the binding agent from the bore and drying the bore surface;

d) introducing a polymerizable single phase monomer solution into the bore;

e) polymerizing the single phase monomer solution to provide the porous medium.

6. The method of claim 5, wherein the step of polymerizing comprises exposure to UV radiation.

7. The method of claim 6, wherein at least a portion of the tube is optically transparent to UV radiation.

8. The method of claim 1, wherein the step of connecting a first end of the EK pump to a fluid reservoir instead comprises connecting a first end of the EK pump to a second EK pump, wherein the second EK pump comprises the solution of SPE monomers.

* * * * *